US005547347A

United States Patent [19]

Sethna et al.

[11] Patent Number: 5,547,347

[45] Date of Patent: Aug. 20, 1996

[54] GAS INJECTION APPARATUS AND METHOD

[75] Inventors: Rustam H. Sethna, New Brunswick; Atul M. Athalye, Chatham, both of N.J.

[73] Assignee: The BOC Group, Inc., New Providence, N.J.

[21] Appl. No.: 531,987

[22] Filed: Sep. 21, 1995

[51] Int. Cl.[6] ..... F04B 25/00

[52] U.S. Cl. ..... 417/250; 417/252; 417/53; 415/116

[58] Field of Search ..... 417/53, 205, 250, 417/252, 253; 415/116

[56] References Cited

U.S. PATENT DOCUMENTS 3,116,872 1/1964 Buechel et al. ..... 417/250

4,059,714 11/1977 Scholl et al. ..... 428/310

4,200,207 4/1980 Akers et al. ..... 417/250

*Primary Examiner*—Charles Freay

*Attorney, Agent, or Firm*—David M. Rosenblum; Larry R. Cassett

[57] ABSTRACT

An apparatus and method for dispersing a gas in a liquid and for increasing gas pressure of a gas from a supply pressure to a delivery pressure. A first pump pumps the liquid to produce a pressurized liquid stream. The gas is injected into the pressurized liquid stream through for instance, a piping tee. The gas injection produces a pressure drop within the gas and as a result, the first pump pumps the liquid stream so that it has a static pressure no greater than the injection pressure. A second pump pumps the resultant pressurized gas-liquid stream so that an outlet liquid stream is produced with the liquid having a greater head than that of the pressurized liquid stream and the gas having the increased delivery pressure.

5 Claims, 1 Drawing Sheet

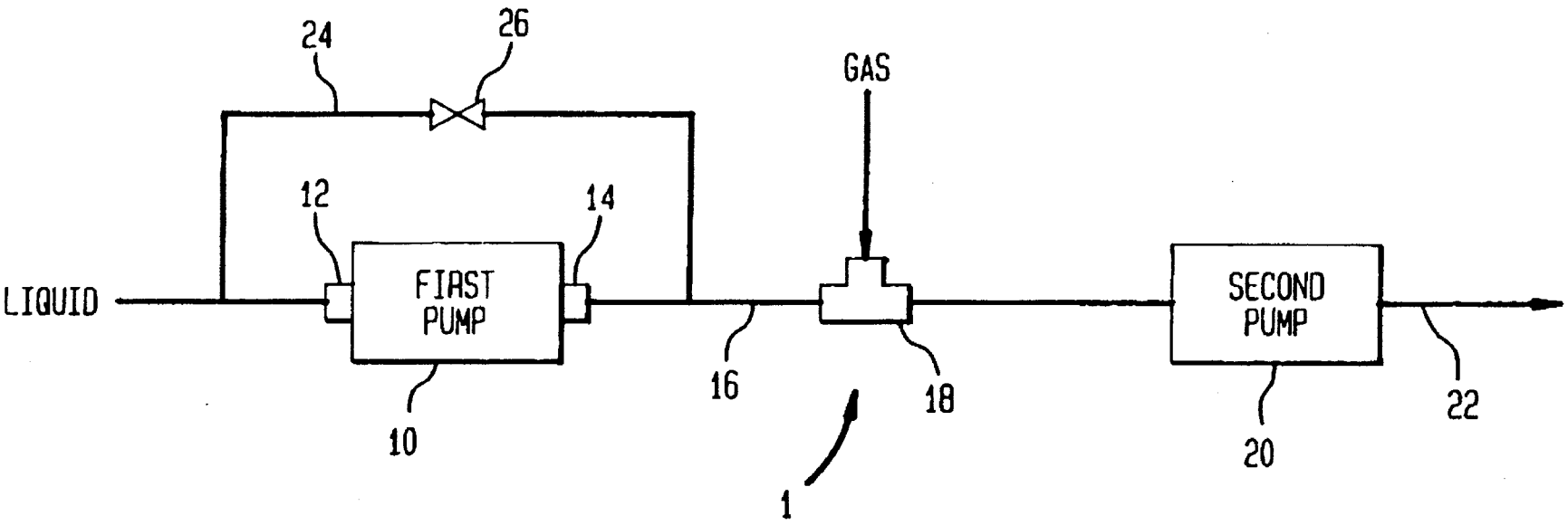
LIQUID
FIRST PUMP
SECOND PUMP
GAS
10
12
14
16
18
20
22
24
26
1

GAS INJECTION APPARATUS AND METHOD

BACKGROUND OF THE INVENTION

The present invention relates to an apparatus and method for injecting a gas into a liquid while increasing gas pressure of the gas from a supply pressure to a delivery pressure. More particularly, the present invention relates to such an apparatus and method in which a first pump pumps the liquid to produce a pressurized liquid stream and a second pump increases the head of the liquid and the gas pressure to the delivery pressure.

There exist many industrial applications in which gases are required to be dispersed into liquids under conditions in which the delivery pressure of the gas is greater than the supply pressure of the gas. These applications are to be distinguished from gas dissolution applications in which foams are required. For instance, U.S. Pat. No. 4,601,645 discloses a two stage gear mixing pump in which a first gear pump increases the head of the liquid which is subsequently lost in a second gear pump. Both gas and liquid are injected into the second gear pump to produce the foam.

An example of an application of interest concerns oxidation of mineral slurries. In such application, oxygen is injected in the bottom of the leaching tank through a pipe having small openings to produce small gas bubbles. Small gas bubbles are more conducive to gas dissolution within a liquid than large gas bubbles because small gas bubbles have a larger interfacial surface area than an equivalent volume of large bubbles. The problem with this mode of gas injection is that the pressure of the oxygen must be raised to overcome the liquid head at the bottom of the leaching tank and to compensate for the pressure drop involved in injecting the oxygen through the small openings. As a result, either a high pressure source of oxygen must be provided or the oxygen must be compressed. Oxygen compression involves expensive oxygen compatible equipment such as specially designed oxygen compressors.

As will be discussed, the present invention provides an apparatus and method for dispersing a gas in a liquid at delivery pressures necessary, for instance, to allow the gas to be injected in the bottom of a leaching tank, while at the same time maintaining small bubble size to enhance the rate of gas dissolution. The foregoing is accomplished without the use of specially designed equipment such as oxygen compressors.

SUMMARY OF THE INVENTION

The present invention provides an apparatus for dispersing a gas into a liquid. A first pump is provided to pump the liquid to produce a pressurized liquid stream. A means is provided for injecting the gas, at a gas injection pressure, into the pressurized liquid stream to produce a pressurized gas-liquid stream. The first pump is configured to pump the liquid such that the pressurized liquid stream has a static pressure no greater than the injection pressure of the gas. A second pump pumps the pressurized gas-liquid stream such that liquid and gas pressures of the liquid and gas, respectively, are greater than the gas injection and static pressures and the gas is broken up into small bubbles. The second pump consists of one of a turbine pump, a centrifugal pump, and an axial propeller pump.

In another aspect, the present invention provides a method of disbursing a gas into a liquid. In accordance with the method, the liquid is pumped to produce a pressurized liquid stream and the gas is injected into the pressurized liquid stream at a gas injection pressure to produce a pressurized gas-liquid stream. The liquid is pumped such that the pressurized liquid stream has a static pressure no greater than the injection pressure of the gas. The pressurized gas-liquid stream is pumped such that liquid and gas pressures of the liquid and gas, respectively, are greater than said static and gas injection pressures and the gas is broken up into small bubbles.

In a practical application of the present invention, the gas is supplied at a supply pressure which can be of the order that is expected from low pressure sources of gas, for instance oxygen supplied by a pressure swing adsorption process. As can be appreciated by those skilled in the art, there are pressure loses in injecting the gas into the pressurized liquid stream. As a result of such pressure loses, the gas is injected into the pressurized liquid stream at a gas injection pressure less than the supply pressure. It is the gas injection pressure which sets the static pressure of the pressurized liquid stream which is no greater than the gas injection pressure to allow the gas to be injected into the liquid. Preferably the static pressure of the pressurized liquid stream is about 5.0 psig less than the gas injection pressure.

The apparatus and method of the present invention allow an outlet liquid stream to be produced with the gas dispersed in the liquid. Since both the head of the liquid and the gas pressure are increased at the same time, large bubbles do not form upon, for instance, introduction of the outlet liquid stream into the bottom of the leaching tank. It is to be noted that the second pump must not be a positive displacement pump. A positive displacement pump would not work because such pumps do not have sufficient capacity in an application of the present invention. Turbine, centrifugal and axial propeller pumps will function to both increase the gas pressure and the head of the liquid and at the same time produce a fine dispersion of the gas within the liquid at substantial flow rates. Thus, unlike prior art two-stage pumping devices employed to produce the foam-like output, the first pump increases the head of the liquid to meet the pressure of the gas being injected. The second pump further increases the head and gas pressure of the gas to the conditions required for the outlet stream.

The present invention has particular application for oxygen injection into mineral slurries or other higher pressure gas-liquid contacting applications. This is accomplished without need for additional and often expensive compressors or blowers. Therefore, the present invention provides a lower capital cost option in situations where high pressure gas-liquid mixtures are required.

BRIEF DESCRIPTION OF THE DRAWINGS

While the specification concludes with claims distinctly pointing out the subject matter that Applicants regard as their invention, it is believed that the invention will be better understood when taken in connection with the accompanying sole figure which is a schematic illustration of an apparatus for carrying out a method in accordance with the present invention.

DETAILED DESCRIPTION

With reference with the figure, an apparatus 1 is illustrated for dispersing a gas in a liquid. Apparatus 1 is provided with a first pump 10 having a pump inlet 12 and a pump outlet 14. Liquid enters as a liquid stream and is pumped from pump inlet 12 to pump outlet 14 to produce a pressurized liquid stream 16 having a greater static pressure than prior to its entry into pump inlet 12. The gas is injected through a piping tee 18 into pressurized liquid stream 16 to produce a pressurized gas-liquid stream. Losses produced by such injection decrease the pressure of the gas from its supply pressure to an injection pressure. First pump 10 is designed so that pressurized liquid stream 16 has a static pressure that is equal to and preferably slightly less than the injection pressure of the gas at its point of injection within pressurized liquid stream 16. A second pump 20 pumps the resultant pressurized gas-liquid stream (after the injection of the gas) to produce an outlet stream having the gas dispersed within the liquid and with liquid having a higher head than the pressurized liquid stream 16 and the gas having a delivery pressure within the outlet stream 22, higher than that of its supply pressure.

It is to be noted that although single first and second pumps 10 and 20 are illustrated, the present invention contemplates the use of multiple pump stages. Hence, in an appropriate application of the present invention, multiple pumps could be substituted for either or both of first and second pumps 10 and 20.

A recycle flow circuit 24 is provided which communicates between pump inlet 12 and pump outlet 14 of first pump 10. A proportional valve 26 is located within the recycle flow circuit 24 to control the flow from pump outlet 14 to pump inlet 12 of recycled liquid. The more liquid recycled, the lower the pressure of pressured outlet stream 16. Recycle flow circuit 24 thereby serves to adjust the static pressure of pressurized liquid stream 16 to match the injection pressure of the gas.

In the illustrated embodiment, first and second pumps 10 and 20 cannot be positive displacement pumps. For instance, if first pump 10 were a positive displacement pump, then the recycle flow circuit 24 would be ineffective to adjust outlet liquid pressure of pump 10. If second pump 20 were a positive displacement pump, then there would not be sufficient operation flexibility or capacity. Thus, both first pump 10 and second pump 20 should be a turbine pump, a centrifugal pump or an axial propeller pump. As can be appreciated, if a recycle flow circuit 24 is not used, first pump 10 could be a positive displacement pump.

Although the present invention has been described with reference to a preferred embodiment, as will occur to those skilled in the art, numerous changes, additions and omissions may be made without departing from the spirit of the present invention.

We claim:

1. An apparatus for dispersing a gas into a liquid, said apparatus comprising:

a first pump to pump said liquid to produce a pressurized liquid stream;

means for injecting said gas, at a gas injection pressure, into said pressurized liquid stream to produce a pressurized gas-liquid stream;

said first pump configured to pump said liquid such that said pressurized liquid stream has a static pressure no greater than said injection pressure of said gas; and a second pump to pump said pressurized gas-liquid stream such that liquid and gas pressures of said liquid and gas, respectively, are greater than said gas injection and static pressures and said gas is broken up into small bubbles;

said second pump consisting of one of a turbine pump, a centrifugal pump and an axial propeller pump.

2. The apparatus of claim 1, wherein said first pump consists of one of a turbine pump, a centrifugal pump and an axial propeller pump.

3. The apparatus of claim 2, further comprising:

said first pump having an inlet and an outlet;

a recycle flow circuit connecting said inlet and said outlet of said first pump; and means for adjusting flow within said recycle flow circuit to thereby control outlet pressure at said outlet of said first pump.

4. The apparatus of claim 3, wherein said injection means comprises a piping tee.

5. A method of dispersing a gas into a liquid comprising:

pumping said liquid to produce a pressurized liquid stream;

injecting said gas, at a gas injection pressure, into said pressurized liquid stream to produce a pressurized gas-liquid stream;

the liquid being pumped such that said pressurized liquid stream has a static pressure no greater than said injection pressure of said gas; and pumping said pressurized gas-liquid stream such that liquid and gas pressures of said liquid and gas, respectively, are greater than said static and gas injection pressures and said gas is broken up into small bubbles.

* * * * *